US005505006A

United States Patent [19]

Wulz et al.

[11] Patent Number: 5,505,006

[45] Date of Patent: Apr. 9, 1996

[54] DEVICE FOR DRYING A RUNNING WEB

[75] Inventors: Hans-Jurgen Wulz; Wolfgang Mayer; Hans-Peter Sollinger, all of Heidenheim; Dieter Herbig, Steinheim, all of Germany

[73] Assignee: J.M. Voith GmbH, United Kingdom

[21] Appl. No.: 303,165

[22] Filed: Sep. 8, 1994

[51] Int. Cl.[6] ..... F26B 11/02

[52] U.S. Cl. ..... 34/117; 34/121

[58] Field of Search ..... 34/117, 121

[56] References Cited

U.S. PATENT DOCUMENTS

| | | | |
|---|---|---|---|
| 4,918,836 | 4/1990 | Wedel . | |
| 4,945,655 | 8/1990 | Wedel . | |
| 5,105,561 | 4/1992 | Wulz | 34/117 |
| 5,311,672 | 5/1994 | Kotitschke et al. | 34/117 |

FOREIGN PATENT DOCUMENTS

| | | | |
|---|---|---|---|
| 0444316 | 7/1994 | European Pat. Off. . | |
| 934367 | 10/1993 | Finland | 34/117 |

*Primary Examiner*—Henry A. Bennett
*Assistant Examiner*—Dinnatia Doster
*Attorney, Agent, or Firm*—Ostrolenk, Faber, Gerb & Soffen

[57] ABSTRACT

A device for drying a running web, particularly a drying section of a paper manufacturing or processing machine. In the drying section, at least one drying cylinder, which can be heated and comes into contact with the web, is provided in each of successive cylinder groups. Each cylinder group has its own drive. At least one two-felt cylinder group is provided in which, the web runs in serpentine fashion alternately over upper cylinders, felted above, and lower cylinders, felted below. At least one additional cylinder group, provided with its own additional drive, is provided adjacent the two-felt cylinder group. Between the two-felt cylinder group and the additional cylinder group there is a free web path at which a tail-cutter is arranged.

33 Claims, 6 Drawing Sheets

FIG. 5'
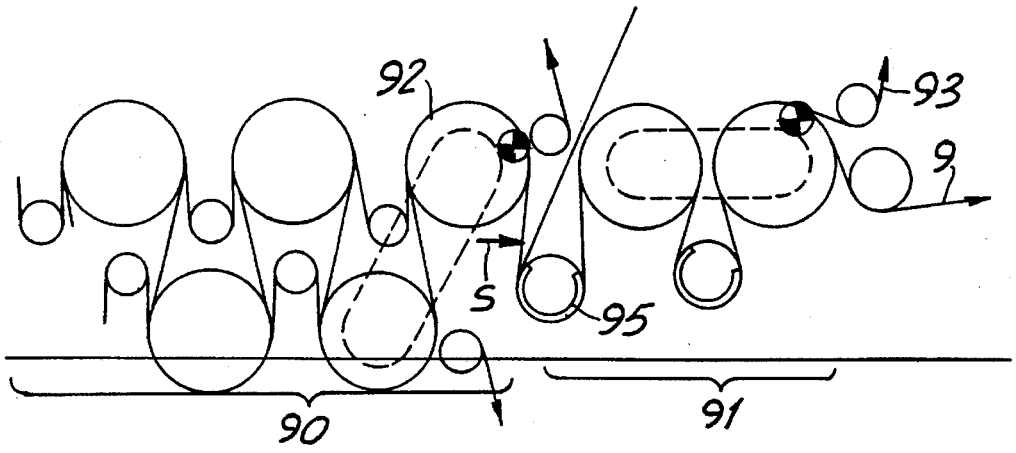
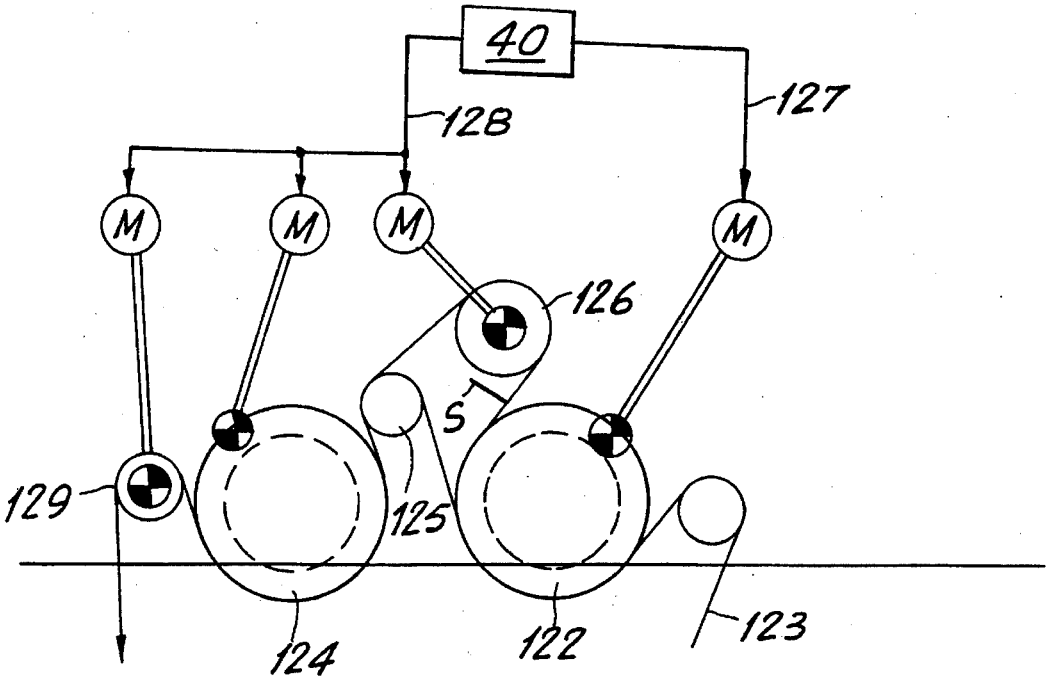
FIG. 10

DEVICE FOR DRYING A RUNNING WEB

BACKGROUND OF THE INVENTION

The present invention relates to a device for drying a running web, for example, the drying section of a paper manufacturing machine. A drying section is disclosed in DE 43 28 554 A1 and is divided into a plurality of successive cylinder groups. Each of these cylinder groups comprises, as a rule, a plurality of heatable drying cylinders which come into contact with the web and which are coupled, for example, via gearwheels and/or an endless supporting belt ("felt"), to a common drive which determines the operating speed of the cylinder group.

The above German patent document DE 43 28 554 A1 discloses that, as also in the subject matter of the present invention, in the initial region of a drying section, preferably a plurality of single-felt cylinder groups are provided, which can be of quite different design. In the end region of the drying section, on the other hand, at least one two-felt cylinder group is provided. For the most part, two (or three) of this type of two-felt cylinder groups are preferred, of which each has an upper and a lower row of cylinders, the web running alternately over the upper and the lower cylinders. From cylinder to cylinder, a free, unsupported web path is provided. Each two-felt cylinder group has in turn a drive of its own. The term "felt" also includes the porous (endless) drying fabrics mostly customary today.

The present invention is concerned with the problem of the threading of the paper web into a paper manufacturing or paper processing machine (for example at start-up of the machine or after an unintentional break of the paper web). This threading of the paper web is carried out mostly, as is known, at full operating speed. When, during threading, the paper web has reached a determined position, for example, the end of the drying section, it is first led, as is known, as broke down into a broke pulping system. At the same time, at one of the two web edges, an initially narrow web part ("edge strip") is severed from the web by means of a tail-cutter. Initially, only said edge strip is transferred to the following units (for example, calendar and winder or coating units). The tail-cutter then runs to the other web edge, so that the transferred web part finally has the full web width. Normally, the tail-cutter is arranged in the end region of the two-felt cylinder group or of the last two-felt cylinder group; see FIG. 1, 12 or 13 of the above-referred to DE '554.

The above-described method is practiced in numerous paper machines, mostly with good success, even in manufacturing machines with relatively high operating speeds. However, it is desirable to be able to carry out the transfer of the paper web from the drying section into the following units with even greater reliability than previously. In this case, it is to be taken into account that, in many cases, the operating speed is intended to be increased even further, approximately to the order of magnitude of from 1600 to 2400 m/min. In so doing, the risk that the paper web breaks during tail-cutting is increased. In such an event, an additional difficulty is that the large quantities of broke accumulating in a short time do not always reliably automatically reach down into the broke pulping system, but instead scraps of broke from time to time remain unchecked in the drying section.

SUMMARY OF THE INVENTION

The invention is based on the object of further developing and improving a drying device for drying a running web, for example, the drying section of a paper manufacturing or processing machine, with the effect that the risk of web breakage during tail-cutting is eliminated as far as possible, even at the ever increasing operating speeds. This is primarily true for the drying section of paper manufacturing machines, but also for drying devices of paper processing machines, for example, coating machines.

The above and other objects are achieved by a device for drying a running web, in particular, a drying section of a paper manufacturing or paper processing machine, comprising: a plurality of successive cylinder groups, each cylinder group having an individual drive, at least one cylinder in each group being heatable and comprising a drying cylinder and coming into contact with the running web; at least one of the cylinder groups comprising a two-felt cylinder group, wherein the web runs in serpentine fashion alternately over upper cylinders, felted above, and lower cylinders, felted below; at least one additional cylinder group adjacent the two-felted cylinder group and provided with an additional drive; a free web path unsupported by a felt provided between the two-felt cylinder group and the additional group; and a tail-cutter disposed at the free web path.

Preferably, in the device of the invention, the drive of the two-felt cylinder group and the drive of the additional cylinder group following the two-felt cylinder group are connected to a common control unit which allows a ratio between an operating speed of the additional cylinder group and an operating speed of the two-felt cylinder group to be set to a specific value. Preferably the ratio for normal long-term operation is a different value than the ratio when tail cutting.

Further, in the device of the invention, the common control until preferably comprises means for:

a) in normal production operation, allowing the setting of an operating speed in the additional cylinder group which is equal to or slightly smaller than the operating speed of the two-felt cylinder group; and b) during operation of the tail-cutter, allowing the setting of an operating speed in the additional cylinder group which is slightly higher than during the normal production operation, thereby setting a web longitudinal tension necessary for tail-cutting.

It is essential that a free web path, which is in the region of the end of the drying section and wherein the longitudinal tension of the web can be set for the requirements of the tail-cutting, be present for the positioning of tail-cutter.

It is common to the different .variants of a first group of exemplary embodiments of the invention that the free web path be provided for the tail-cutter always at the end of a two-felt cylinder group. By this means, important advantages of the drying sections disclosed in the above described DE '554 are maintained, specifically:

1. Uniform paper quality, especially identical or almost identical surface properties on both sides of the paper.
2. Even when a very high final dryness content is sought (of the order of 98%), there is no risk of paper web breaks, since longitudinal tensions can be dissipated in the two-felt cylinder group.
3. Compared with drying sections which exclusively have single-felt cylinder groups, the wear on the felts (drying fabrics) is significantly less.

The free web path for the tail-cutter can (but need not) be a so-called felt separation point; in this case, the felts of the two-felt cylinder group run back from this point to the beginning of the respective group. This means that the following additional cylinder group has at least one additional felt of its own, which guides the paper web further after the felt separation point.

In a further variant of the first group of exemplary embodiments of the invention, the free web draw for the tail-cutter lies at the point where at least one of the two felts of the two-felt cylinder group bridges a separation point between two drive groups. In other words: the felt (or the felts) bridges (or bridge) the "boundary" between the two-felt cylinder group and the following additional cylinder group. Preferably, the "boundary" is bridged by only one of the two felts. This means that at this "boundary", one of the two felts of the two-felt cylinder group runs back to the beginning of the same. In these cases, the other of the two felts is extended and runs additionally over the cylinders of the additional cylinder group, which is here a single-felt cylinder group (having its own drive). In this case, this extended felt is somewhat stretched at the "boundary" by the drive of the additional cylinder group, if the paper web is intended to be tensioned during tail-cutting. This stretching of the felt disappears again, however, at the latest when the felt runs back to the beginning of the two-felt cylinder group.

The additional cylinder group following the tail-cutter can comprise quite a different number of cylinders. In many cases, one to three cylinders are sufficient. However, this number can be raised from four to, for example, eight cylinders in the event that the final dryness content of the web is intended to be extremely high, for example 98%.

The above-described summary of the invention, relating to the variant in which one felt bridges the separation point between two drive groups, can also be applied in a second group of exemplary embodiments. In these embodiments, two neighboring cylinder groups may be provided, of which each has a drive of its own; each of these cylinder groups can have a plurality of cylinders, in the extreme case, however, only a single cylinder may be provided in each group. All cylinders of the two groups come into contact with the same side of the web; this is because only a single endless felt is associated with them. This felt must also bridge the boundary between the two cylinder groups. It can also be said that what is described is one single-felt cylinder group, which is divided into two drive groups. The exact nomenclature is unimportant, since the same device is being described with different terminology. At the boundary between the two drive groups, the felt runs from one of the cylinders over a felt guiding roll, directly to the next cylinder, while the paper web makes a detour over an additional unfelted roll (or cylinder) before it reaches the next cylinder. Consequently, in the region of the boundary, a free web path is present for a tail-cutter, wherein the web longitudinal tension can be set to an optimal value for the tail-cutting, due to the two separately controllable drives.

Drying devices of this type according to the invention can be applied primarily (but not exclusively) in paper processing machines, for example, coating machines.

Other features and advantages of the present invention will become apparent from the following description of the invention which refers to the accompanying drawings.

BRIEF DESCRIPTION OF THE DRAWING(S)

Figure 5:
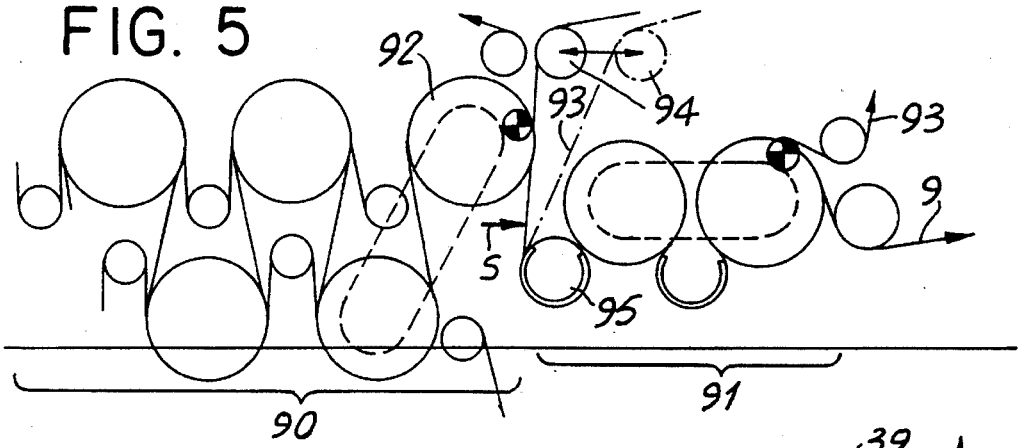
FIGS. 5–8 are schematic side views of the end region of further different drying sections according to the invention.
Figure 9:
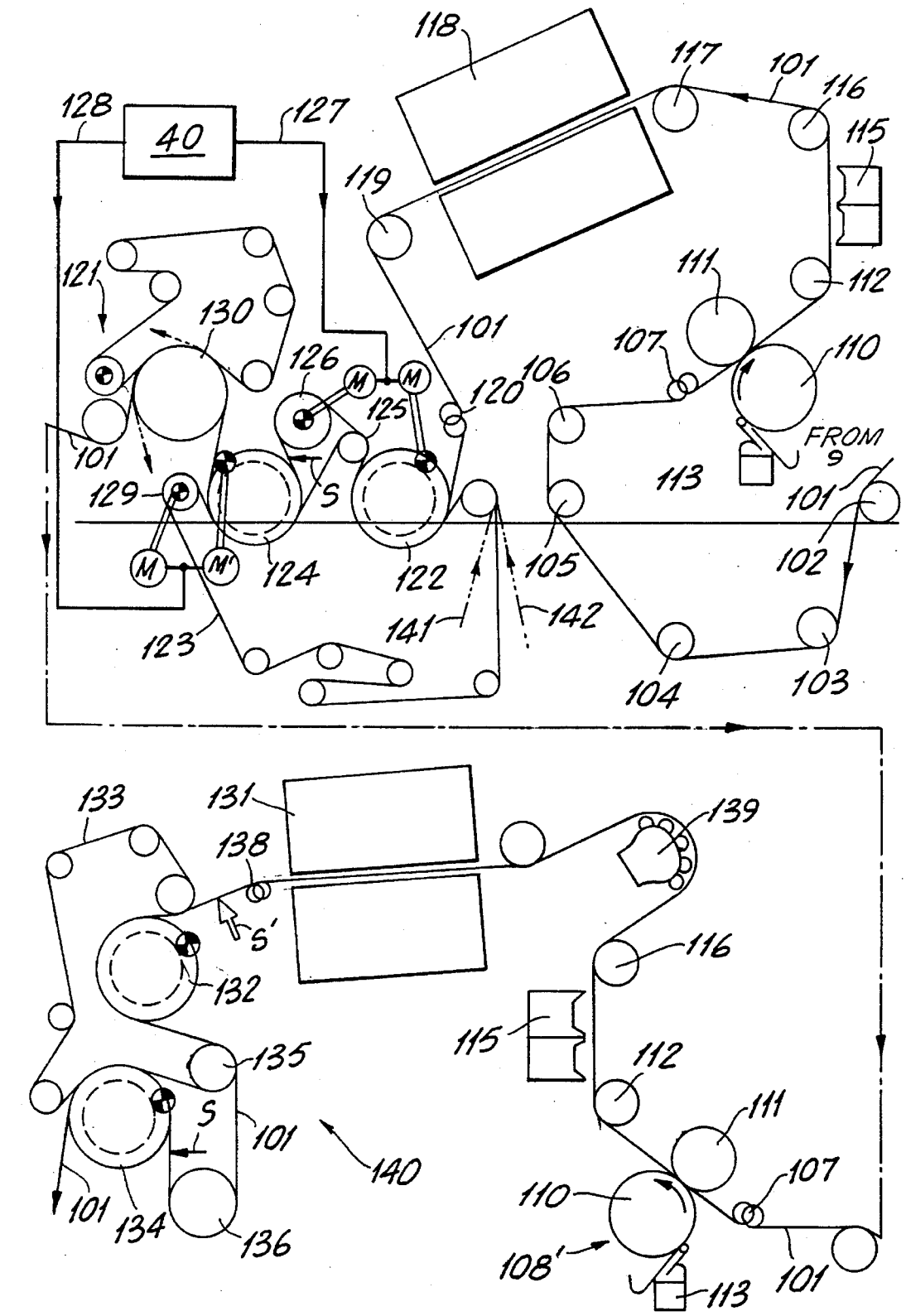

FIG. 5' shows an embodiment in a schematic side view of the end region of a drying section which is a variant of that shown in FIG. 5;

FIG. 9 shows a paper coating machine with the associated drying cylinder groups according to the invention; and FIG. 10 shows a further embodiment of the invention.

DETAILED DESCRIPTION OF EMBODIMENTS OF THE INVENTION

Figure 1:
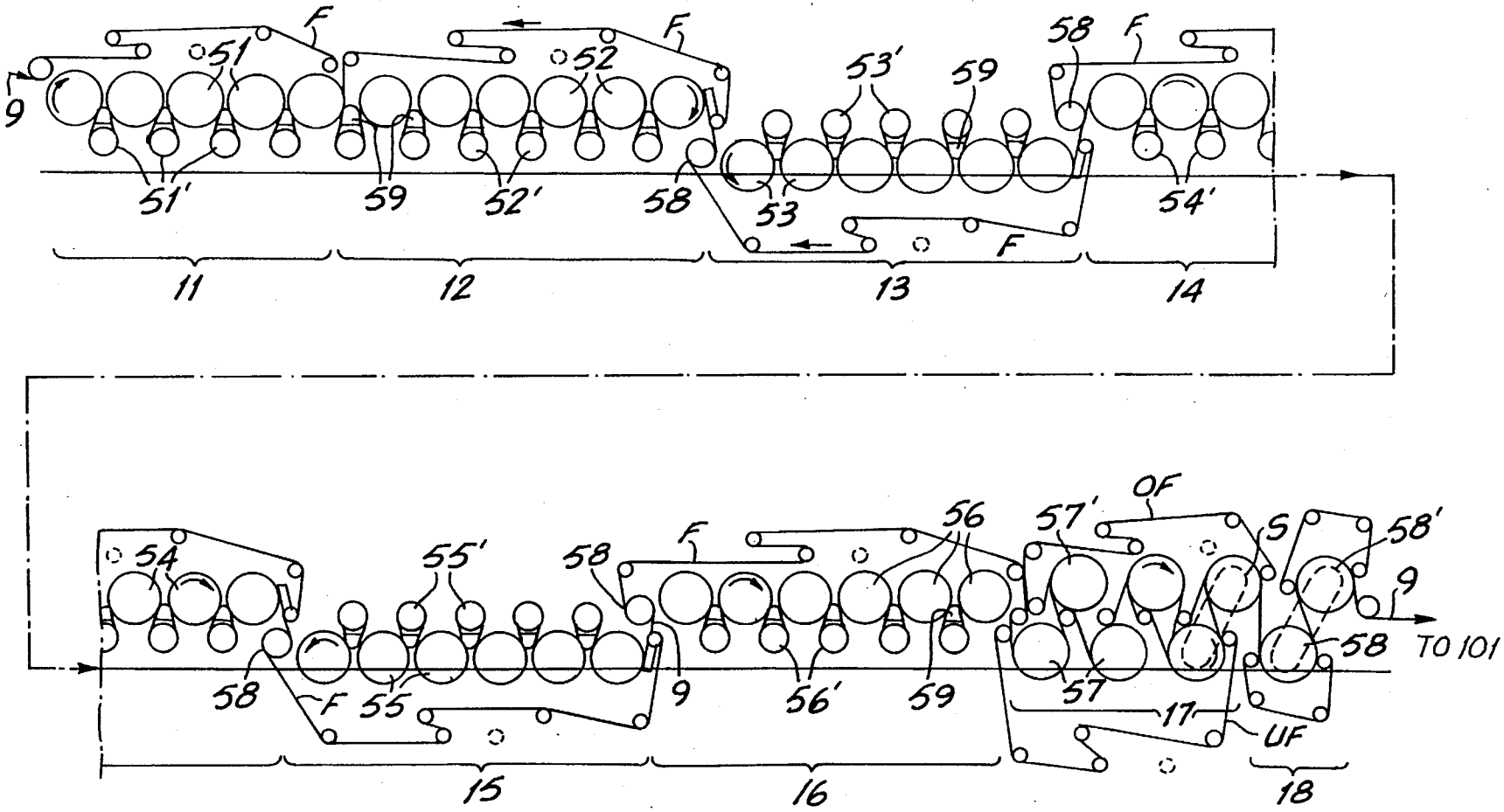
FIGS. 1–3 show schematic side views of a plurality of different drying sections of paper manufacturing machines according to the invention.

With reference now to the drawings, the drying section shown in FIG. 1 first has six single-felt cylinder groups (11–16) arranged one behind the other. Each of these cylinder groups has a respective single endless felt F. As an example, in the first cylinder group (11), the felt F runs together with the web (9) alternately over drying cylinders (51) and over deflection rolls (51'), which are preferably designed as suction rolls. In the first two cylinder groups (11) and (12), and in the fourth and in the sixth cylinder group (14, 16), the underside of the web comes into contact with the cylinders. Correspondingly, the drying cylinders (51, 52, 54, 56) are here above the associated deflection suction rolls (51', 52', 54' and 56'); the cylinders are here described as "felted above". It is otherwise, however, in the third cylinder group (13) and in the fifth cylinder group (15): here the cylinders (53, 55) come into contact with the upper side of the web; they are therefore "felted below" and are beneath the associated deflection suction rolls (53', 55'). Consequently, the separation points present between the cylinder groups (12) to (16) are designed as so-called turning separation points. With reference to the details of these turning separation points, specific reference may be made to German Patent Application P 43 11 351.

It can be seen from FIG. 1 that, at each of these turning separation points, the paper web (9) forms a short open draw; that is to say it is temporarily not supported by a felt. It runs in the region of a small suction zone of a transfer roll (58) onto the next respective felt. In FIG. 1 these transfer rolls (58) are individual suction rolls with internal stationary suction boxes. The deflection suction rolls (51'–56') are, in contrast, free from inner stationary built-in fittings and from direct suction connections. Instead, an external suction box (59) is provided on each of these deflection suction rolls. This suction box (59) lies in the so-called pocket between two neighboring drying cylinders and has, at the point where felt F and web (9) together leave the first of these two cylinders, a strip (not visible in the drawing), which strips off and deflects the air boundary layer transported along by the felt.

After the last single-felt cylinder group (16), there follows a two-felt cylinder group (17) with several lower cylinders (57) and several upper cylinders (57'), and with a lower felt UF and an upper felt OF. Here the web (9) runs in serpentine fashion alternately over the lower and upper cylinders. Thereafter, the web runs over a free web path, on which a tail-cutter S is arranged, to an additional cylinder group (18). This comprises two commonly driven but individually felted cylinders (58, 58').

Figure 2:
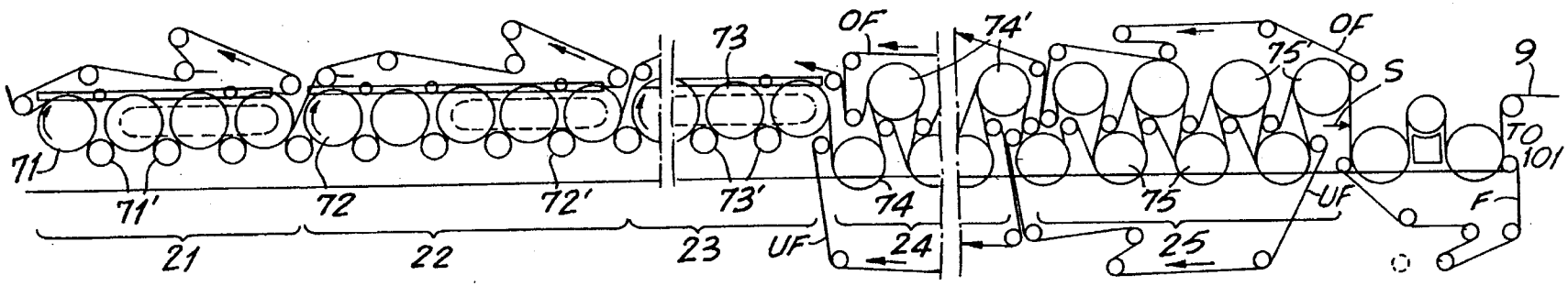

The drying section shown in the embodiment of FIG. 2 has, for example, three (or four or five or more) single-felt cylinder groups (21–23); these are, however, in contrast to FIG. 1, all felted above. In other words: all the drying cylinders (71–73) contact the underside of the web. A further difference from FIG. 1 consists in that the deflection suction rolls (71'–73') have internal stationary suction boxes and are arranged at only a small distance from the neighboring drying cylinders. Moreover, for example, two (or three or more) two-felt cylinder groups (24, 25) having lower cylinders (74, 75) and having upper cylinders (74', 75') are now provided, as well as an additional cylinder group (26), once again with a tail-cutter S in the free web draw before this cylinder group. This latter cylinder group is in a single row and felted below.

Figure 3:
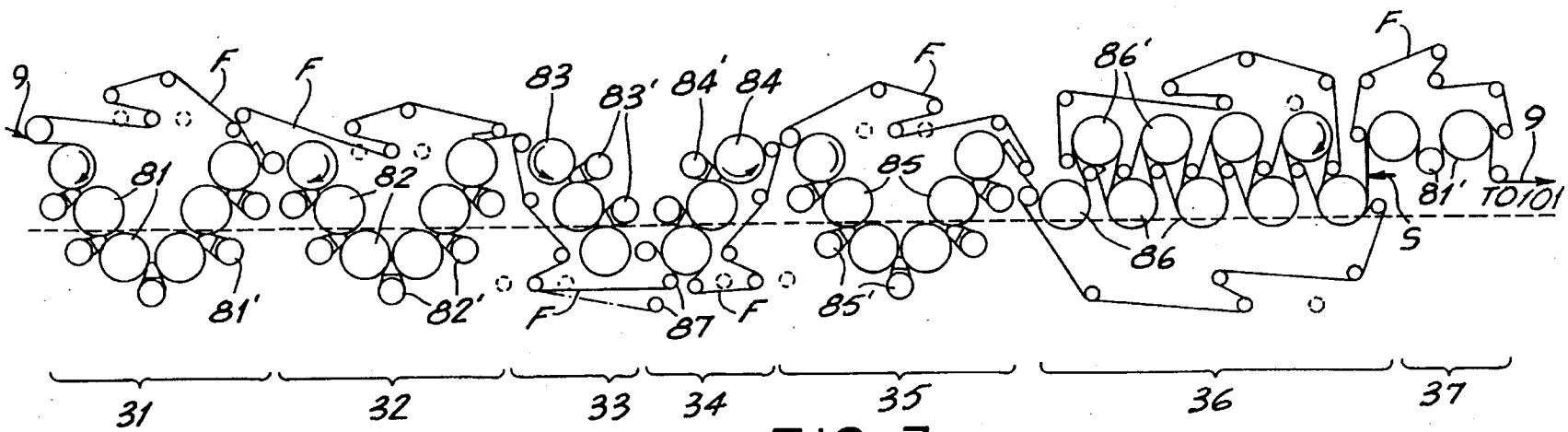

While the drying sections according to FIGS. 1 and 2 have exclusively horizontal rows of cylinders, the following is provided in the embodiment of FIG. 3: for the purpose of reducing the total constructional length of the drying section, the cylinders of the single-felt cylinder groups (31–35), as is disclosed in DE 40 41 493, are arranged in a plurality of rows inclined toward the vertical direction, in rows inclined backwardly and forwardly following each other alternately. Two V-shaped double rows form a first cylinder group (31) and a second cylinder group (32). The cylinders (81, 82) of these two cylinder groups are felted above. Thereafter follow two cylinder groups (33, 34) which are felted below. The, for example, three (or four or more) cylinders (83) of the third cylinder group form a row inclined backwardly. In contrast, the cylinders (84) of the fourth cylinder group form a row inclined forwardly. Between the lowest cylinders of these two cylinder groups (33, 34) a gap can be opened, for the purpose of removing broke downwardly, by means of a pivotable felt guiding roll (87).

The fifth cylinder group (35) has, again, drying cylinders (85) felted exclusively above, which again form a V-shaped double row. After the last cylinder of this cylinder group (35), the web is led obliquely downwardly to the first lower cylinder (86) of the following two-felt cylinder group (36). Following this cylinder group there is once again an additional cylinder group (37) and a tail-cutter S. The free web path for the tail-cutter S runs from below upwardly. Consequently, the cylinder group (37), which preferably has two cylinders (87) and a deflection roll (87') between them, is felted above. This simplifies the guiding of broke away from the cylinders (87) in a downwardly direction.

In contrast to the above-described DE '493, all the deflection suction rolls (81'–85'), which are arranged in the respective cylinder group between two cylinders, are arranged at an increased distance from these cylinders and are equipped with external suction boxes. This constructional method can be manufactured not only at lower cost; it is, moreover, also energy-saving; this is because an extended free evaporation path is present between each two cylinders, so that the drying is more economical. The latter comments are also valid for the arrangement according to FIG. 1.

Deviating from FIG. 3, instead of the fifth single-felt cylinder group (35) present there, a (two-row) two-felt cylinder group (similar to the group 36) can be provided.

Figure 4:
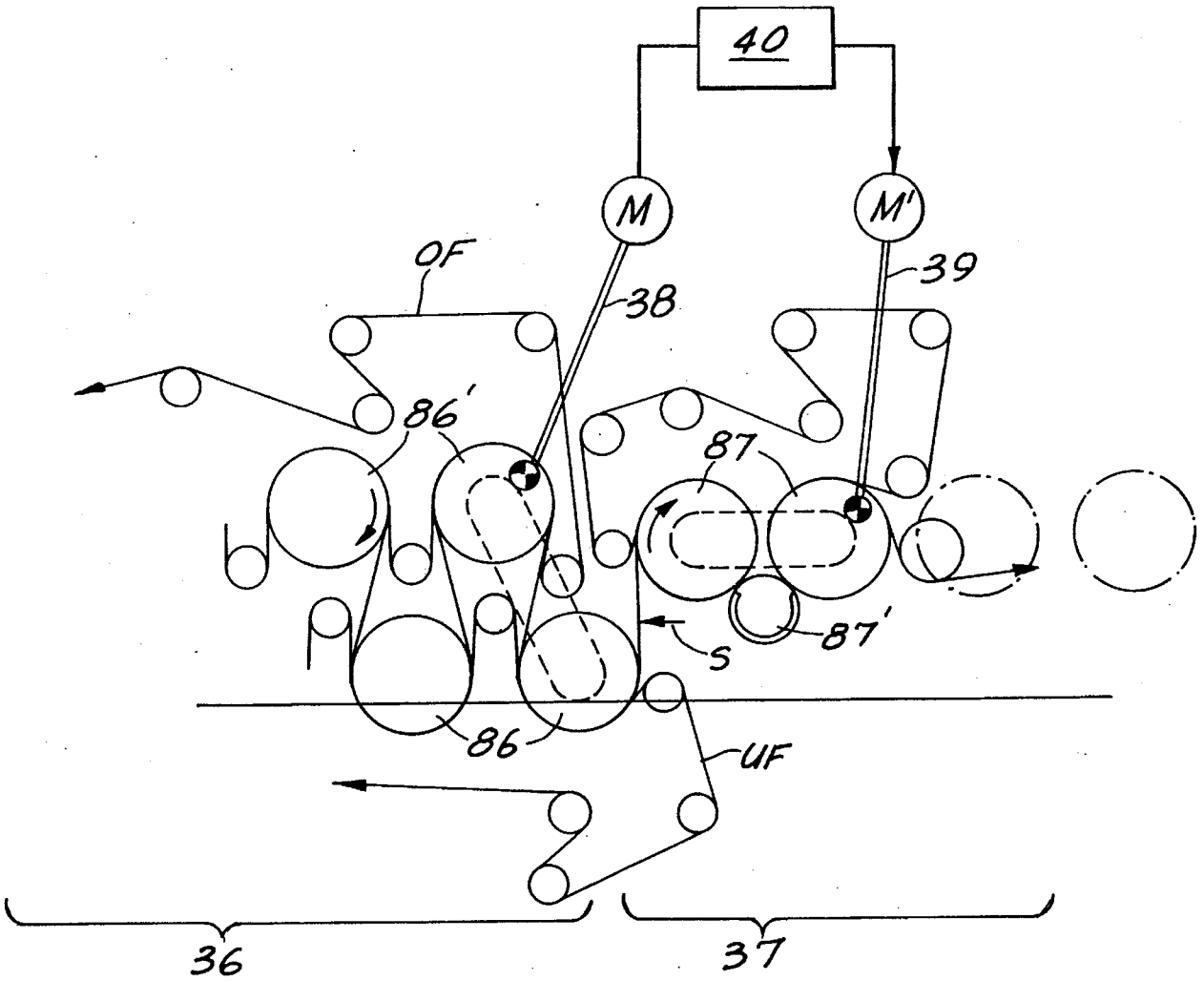
FIG. 4 shows the end region of the drying section according to FIG. 3 on an enlarged scale, with some additional details relating to the control of the individual drives.

FIG. 4 shows details of the cylinder groups 36 and 37 of FIG. 3. In FIG. 4, it is schematically indicated that, in the two-felt cylinder group (36), the two last cylinders (an upper and a lower cylinder) have a common drive (38) having a motor M. The other cylinders of the two-felt cylinder group (36) are, for example, driven via the felts (OF, UF) or by means of an additional drive, not shown. The additional cylinder group (37) has likewise a drive (39) of its own having a motor M'; it could also comprise more than only two cylinders 87, as is indicated with two dotted circles 87". The diameter of the cylinders 87 can be smaller than or equally large as or preferably larger than the diameter of the cylinders 86/86'.

Both motors are connected independently of each other to a control unit 40. By this means, according to requirements, the operating speed of the additional cylinder group 37 and the operating speed of the two-felt cylinder group 36 can be set in a specific ratio to each other, so that a web longitudinal tension favorable for tail-cutting is produced in the free web path. A reliable operation of the tail-cutter S is thus achieved. In particular, web breaks during operation of the tail-cutter can be avoided. During normal production operation, however, a somewhat different ratio between the motor operating speeds can be set than during the tail-cutting, if desired, for the purpose of dissipating longitudinal tensions in the web (9).

According to the embodiment of FIG. 5, a two-felt (depicted partially) cylinder group 90 and an additional single-felt (depicted partially) cylinder group 91, felted above, are provided. The last cylinder 92 of the two-felt cylinder group 90 is in the upper row of cylinders and is therefore felted above. So that the paper web 9 to be dried changes over from the two-felt cylinder group 90 to the single-felt cylinder group 91, the felt 93 of the single-felt cylinder group contacts a small part of the periphery of the cylinder 92. Shortly before this, felt 93 runs over an adjustable guiding roll 94. For tail-cutting, this roll 94 is brought into the position represented with a chain-dotted line, so that the felt runs directly from the roll 94 to the first deflection roll 95 (which can be a suction roll). By this means, the paper web 9 runs without support of the felt 93 from the cylinder 92 to the deflection roll 95. Therefore, the tail-cutter S can be arranged in this free web draw. This type of tail-cutter arrangement has similarities with that according to U.S. Pat. No. 5,248,390.

A further advantageous tail-cutter arrangement is shown in FIG. 5'. FIG. 5' differs essentially from FIG. 5 by the following features: the paper web 9 runs from the last cylinder 92 of the two-felt cylinder group 90 permanently over a free web path to a suction guiding roll 95 and is there sucked onto the felt 93 of the following single-felt cylinder group 91 by means of vacuum. This felt 93 then guides the paper web in a known way through the group 91. The tail-cutter S is once more arranged in the region of the free web path.

Figure 6:
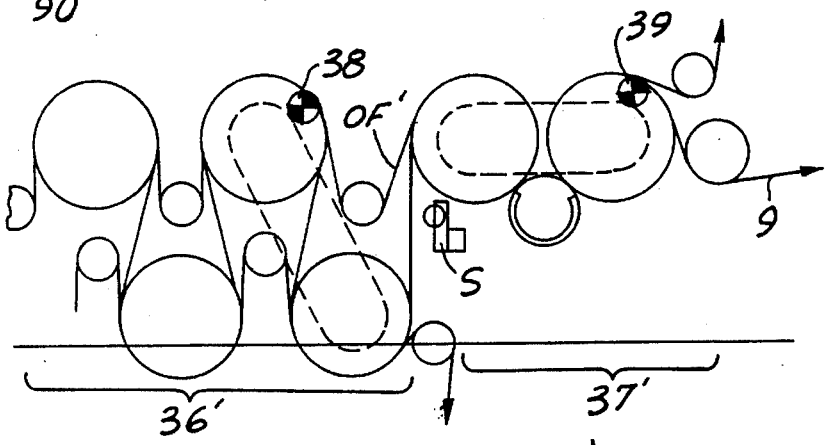

The embodiment of FIG. 6 differs from FIG. 4 essentially only in that the two-felt cylinder group 36' and the additional cylinder group 37' (which is a single-felt cylinder group, felted above) have a common upper felt OF'. The drives 38 and 39 are, nevertheless, designed as shown in FIG. 4.

Figure 7:
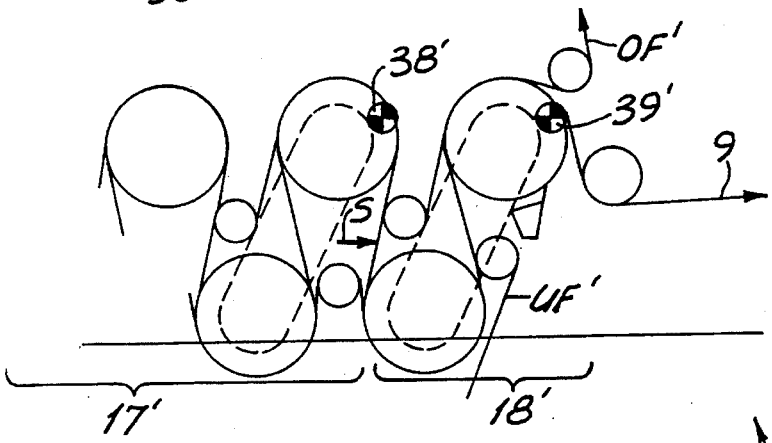

The embodiment according to FIG. 7 has similarities with the end region of the drying section according to FIG. 1. While in FIG. 1 each of the cylinders 58, 58' of the additional cylinder group 18 has a felt of its own, the following is provided in FIG. 7: both cylinder groups 17' and 18' each have a common upper felt OF' and a common lower felt UF'. Nevertheless, each of the cylinder groups 17' and 18', as in FIG. 4, has its own drive 38' and 39'. The tail-cutter S is once more arranged where the paper web 9 changes over from the last cylinder of the cylinder group 17', on a free web path, to the first cylinder of the cylinder group 18'.

Figure 8:
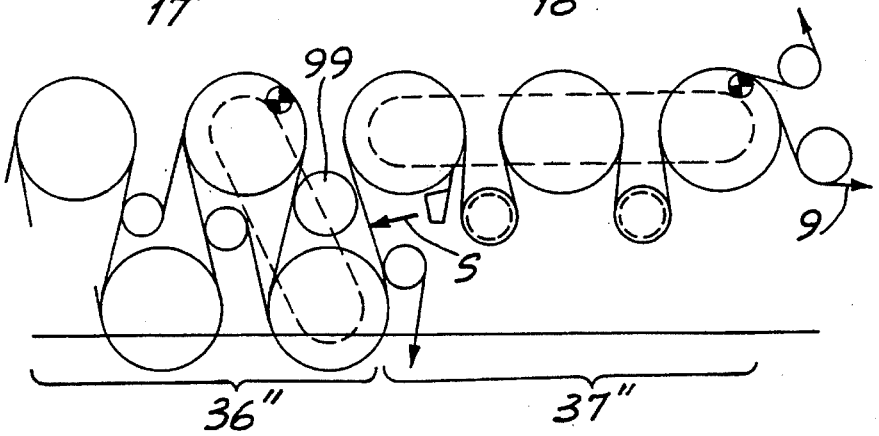

The embodiment of FIG. 8 has similarities with that of FIG. 6. Once more a two-felt cylinder group 36" and an additional cylinder group 37", felted above, are provided and both cylinder groups have a common upper felt OF'. The additional cylinder group 37" includes as an example, three drying cylinders and a grooved deflection roll between each two cylinders. In the two-felt cylinder group 36", the felt guiding rolls are arranged in such a way that the free web paths from cylinder to cylinder are shortened. So that the free web path for the tail-cutter S is also as short as possible, there is, between the last upper cylinder of the cylinder group 36" and the first cylinder of the additional cylinder group 37", a felt guiding roll 99, of relatively large diameter, over which the upper felt runs and to which both web paths are tangential.

FIG. 9 shows a paper coating machine with the associated drying cylinder groups according to the invention. As is illustrated in FIG. 9, a material web 101, for example, a paper web 9 from a plurality of drying cylinders groups as shown in FIGS. 1–3, runs over web guiding rolls 102 to 107 into a first coating station 108. The coating station 108 comprises an application roll 110, a counter-roll 111 lying opposite the latter and forming a press nip with it, and an applicator 113.

Downstream of the first coating station 108 there is a web guiding roll 112 which deflects the material web running out of the press nip from its direction running obliquely upwardly into an essentially vertical direction upwardly. In this way it reaches an infrared dryer 115 and is then guided over two further web guiding rolls 116 and 117 through a hot-air dryer 118. The material web is subsequently delivered to a first contact drying cylinder arrangement 121 via web guiding rolls 119 and 120.

Associated with the arrangement 121 is a row of at least two drying cylinders 122, 124, felted below, which have drives controllable independently of each other, but a common lower felt 123. The felt runs, inter alia, over a felt guiding roll 125 arranged between the two cylinders. The paper web leaves the lower felt at the felt guiding roll 125 and runs freely to a paper guiding roll 126 additionally provided and from the roll 126, past the position of the tail-cutter S, to the cylinder 124. If necessary, the paper guiding roll 126 can have its own drive. In the exemplary embodiment shown, the two motors M of the cylinder 122 and of the paper guiding roll 126 are coupled to a central control unit 40 via a common control lead 127. However, these two motors can also be controllable independently of each other.

It is important that the second cylinder 124 has a drive of its own with a motor M' which is coupled to the central control unit 40 via a separate control lead 128. If necessary, yet another following felt guiding roll 129 can be provided with a drive M'.

The web 101 runs from the cylinder 124 to a further cylinder 130, felted above, and thereafter to a second coating station 108', which is designed essentially as a mirror-image of the first coating station 108. The components corresponding to each other are provided with the same designations in the drawing figure.

After leaving the coating station 108', the material web 101 again passes an infrared dryer 115. It is subsequently fed into a hot-air dryer 131 via a deflection device 139, operating without contact with the web. From here, the material web 101 runs over a spreading roll 138 into a second contact drying cylinder arrangement 140.

The latter comprises once again two drying cylinders 132, 134, which can be driven independently of each other, having a single felt 133. This runs between the cylinders over a felt guiding roll 135, on which the paper web 101 once again leaves the felt, in order to run freely to the paper guiding roll 136 and from there to cylinder 134. Once again, by means of the mutually independent drives of the two cylinders 132 and 134, the web longitudinal tension can be set appropriately at the position of the tail-cutter S.

FIG. 9 shows yet another alternative tail-cutter position S' between the spreading roll 138 and the drying cylinder 132.

It is to be understood that each of the tail-cutters S can become effective only when the paper web 101 at full web width has reached the position of the tail-cutter. Before this, the paper web also runs here initially only in the form of a narrow edge strip through the coating machine. In order to thread this narrow edge strip properly, a rope feed known per se is present (as usual on coating machines). This comprises two endless ropes, for example shown symbolically at 141 and 142 in FIG. 9, which run along the route of the web 101 over the cylinders and guiding rolls (for example over 122, 125, 126, 124 and 130) and, in so doing, draw the arriving point of the edge strip into the machine. Also dispensed with are special, for example pneumatic, auxiliary devices, which would be necessary for rope-less threading of the edge strip.

It is further noted that in the additional cylinder groups, e.g. 18, 26, 37, 91, etc., at least one cylinder can optionally be heated, e.g. by steam, or cooled, e.g., by a suitable cooling medium. Furthermore, at least one cylinder can alternatively be heated or cooled, depending on the specifications of the different paper grades to be manufactured.

In FIGS. 9 and 10, a pocket in the web formed by the guiding rolls 126, 136 is provided where the tail-cutter S is arranged. The advantage of the configuration shown in FIGS. 9 and 10 is that the free web path (where the tail-cutter will cut into the web) is relatively short. Nevertheless, the pocket is large enough to arrange the tail-cutter at the pocket. A relatively short web path improves the reliability of the tail cutting process, i.e., the risk of web breaks during tail cutting is minimized. This configuration can also be used without requiring that all the cylinders have individual drives.

Although the present invention has been described in relation to particular embodiments thereof, many other variations and modifications and other uses will become apparent to those skilled in the art. Accordingly, the present invention should be limited not by the specific disclosure herein, but only by the appended claims.

What is claimed is:

1. A device for drying a running web, in a drying section of a paper manufacturing or paper processing machine, comprising:

a plurality of successive cylinder groups, each cylinder group having an individual drive, at least one cylinder in each group being heatable and comprising a drying cylinder and coming into contact with the running web;

at least one of the cylinder groups comprising a two-felt cylinder group, wherein the web runs in serpentine fashion alternately over upper cylinders, felted above, and lower cylinders, felted below;

at least one additional cylinder group adjacent to the two-felt cylinder group and provided with an individual drive;

a free web path unsupported by a felt provided between the two-felt cylinder group and the additional cylinder group; and a tail-cutter arranged at the free-web path.

2. The device as claimed in claim 1, wherein a free web path unsupported by a felt is provided between cylinders in said at least one two-felt cylinder group.

3. The device as claimed in claim 1, wherein the additional cylinder group comprises a two-felt cylinder group having an upper felt for at least one upper cylinder and a lower felt for at least one lower cylinder.

4. The device as claimed in claim 1, wherein the additional cylinder group comprises a single-felt cylinder group having at least one cylinder.

5. The device as claimed in claim 4 wherein the additional cylinder group has at least two cylinders.

6. The device as claimed in claim 4, wherein the additional cylinder group has its own felt.

7. The device as claimed in claim 4, wherein one of the two felts of the two-felt cylinder group is extended and runs additionally over the cylinders of the additional cylinder group.

8. The device as claimed in claim 1, wherein a last cylinder of the two-felt cylinder group is felted above and wherein, in the additional cylinder group, at least a first cylinder following the two-felt cylinder group is felted below.

9. The device as claimed in claim 8, wherein all cylinders of the additional cylinder group are felted below.

10. The device as claimed in claim 1, wherein a last cylinder of the two-felt cylinder group is felted below and wherein, in the additional cylinder group, at least a first cylinder following the two felt cylinder group is felted above.

11. The device as claimed in claim 10, wherein all cylinders of the additional cylinder group are felted above.

12. The device as claimed in claim 1, wherein the drive of the two-felt cylinder group and the drive of the additional cylinder group following the two felt cylinder group are coupled to a common control unit which allows a ratio between an operating speed of the additional cylinder group and an operating speed of the two-felt cylinder group to be set to a specific value.

13. The device as claimed in claim 12, wherein the ratio for normal long-term operation of the device is a different value than the ratio when tail-cutting.

14. The device as claimed in claim 12, wherein the common control unit comprises means for:

a) in normal production operation, allowing the setting of an operating speed in the additional cylinder group which is equal to or slightly smaller than the operating speed of the two-felt cylinder group; and b) during operation of the tail-cutter, allowing the setting of an operating speed in the additional cylinder group which is slightly higher than during the normal production operation, thereby setting a web longitudinal tension necessary for tail-cutting.

15. The device as claimed in claim 1, wherein at least one of the cylinder groups preceding the two-felt cylinder group comprises a single-felt cylinder group, in which a single endless felt and the web run together in serpentine fashion alternately over cylinders and over deflection rolls.

16. The device as claimed in claim 15, wherein the deflection rolls comprise suction rolls.

17. The device as claimed in claim 1, wherein at least one cylinder of the additional cylinder group can optionally be heated or cooled.

18. The device as claimed in claim 17, wherein the at least one cylinder of the additional cylinder group, corresponding to requirements of different paper grades to be manufactured, can be alternately heated and cooled.

19. A device for drying a running web, in a drying section of a paper manufacturing or paper processing machine, comprising:

a plurality of successive cylinder groups, each cylinder group having an individual drive, at least one cylinder in each group being heatable and comprising a drying cylinder and coming into contact with the running web;

at least two of the cylinder groups comprising single-felt cylinder groups following each other directly and having a single common felt, each of the single-felt cylinder groups having at least one drying cylinder;

a web guiding roll, contacted only by the web, provided between two adjacent cylinders of each of the single felt cylinder groups, thereby providing a free web path unsupported by the felt; and a tail-cutter arranged at the free web path.

20. The device as claimed in claim 19, wherein two adjacent cylinders of each single felt cylinder group are driven independently of each other.

21. The device as claimed in claim 19, further comprising a felt guiding roll disposed between the two adjacent cylinders of the single felt cylinder groups.

22. The device as claimed in claim 19, wherein the free web path at which the tail cutter is arranged leads from the web guiding roll to a following cylinder.

23. The device as claimed in claim 20, wherein the drives of the two adjacent cylinders of each single felt cylinder group are coupled to a common control unit which allows a ratio between an operating speed of the two cylinder to be set to a specific value.

24. The device as claimed in claim 23, wherein the ratio for normal long-term operation of the device is a different value than the ratio when tail-cutting.

25. The device as claimed in claim 23 wherein, the common control unit comprises means for:

a) in normal production operation, allowing the setting of an operating speed in a downstream one of the two adjacent cylinders which is equal to or slightly smaller than the operating speed of an upstream one of the two adjacent cylinders; and b) during operation of the tail-cutter, allowing the setting of an operating speed of the downstream one of the two adjacent cylinders which is slightly higher than during the normal production operation, thereby setting a web longitudinal tension necessary for tail-cutting.

26. A device for drying a running web, in a drying section of a paper manufacturing or paper processing machine, comprising;

at least a first and a second successive drying cylinders have a single common felt, each cylinder coming into contact with the same side of the web;

a felt guiding roll disposed between said two cylinders;

a guiding roll contacting only the web and being provided between said two cylinders; and a tail-cutter arranged at a free web-path unsupported by the felt, said web-path leading from the web guiding roll to the second cylinder.

27. The device as claimed in claim 26, wherein each cylinder has an individual drive.

28. The device as claimed in claim 27, where the web guiding roll has a drive which is connected to the drive of the first cylinder.

29. The device as claimed in claim 26, wherein a pocket in the web is defined by the following elements:

a) the felt running from the first cylinder via the felt guiding roll to the second cylinder;

b) the web guiding roll; and c) the web travelling from the first cylinder via the web guiding roll to the second cylinder;

and wherein the tail-cutter is arranged within said pocket.

30. A device for drying a running web, in a drying section of a paper manufacturing or paper processing machine, comprising:

at least a first and a second successive drying cylinders having a single common felt, each cylinder coming into contact with the same side of the web;

a felt guiding roll disposed between said two cylinders;

a web guiding roll contacting only the web and being provided between said two cylinders; and a tail-cutter arranged at a free web-path unsupported by the felt, said web-path leading from the first cylinder to the web guiding roll.

31. The device as claimed in claim 30, wherein each cylinder has an individual drive.

32. The device as claimed in claim 30, wherein the web guiding roll has a drive which is connected to the drive of the second cylinder.

33. The device as claimed in claim 30, wherein a pocket is defined by the following elements:

a) the felt running from the first cylinder via the felt guiding roll to the second cylinder;

b) the web guiding roll; and c) the web travelling from the first cylinder via the web guiding roll to the second cylinder;

and wherein the tail-cutter is arranged within said pocket.

* * * * *